US008505521B2

(12) United States Patent
Matsushima

(10) Patent No.: US 8,505,521 B2
(45) Date of Patent: Aug. 13, 2013

(54) BREATHER APPARATUS FOR ENGINE

(75) Inventor: Toshiyuki Matsushima, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 166 days.

(21) Appl. No.: 13/243,233

(22) Filed: Sep. 23, 2011

(65) Prior Publication Data

US 2012/0080015 A1 Apr. 5, 2012

(30) Foreign Application Priority Data

Sep. 30, 2010 (JP) ..... 2010-221041

(51) Int. Cl.
*F01M 13/00* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS

| | | | | |
|---|---|---|---|---|
| 7,717,101 | B2 * | 5/2010 | Beetz et al. | 123/572 |
| 2007/0175458 | A1 * | 8/2007 | Hochmayr et al. | 123/572 |
| 2009/0205618 | A1 * | 8/2009 | Hirota | 123/572 |

FOREIGN PATENT DOCUMENTS

| | | |
|---|---|---|
| JP | 2009-030580 | 2/2009 |

* cited by examiner

*Primary Examiner* — M. McMahon
(74) *Attorney, Agent, or Firm* — Konomi Takeshita

(57) ABSTRACT

This breather apparatus has a rotation separator that is fastened to a camshaft, and that rotation separator has a base plate section and a plurality of protruding plates that extend from the base plate section. Moreover, a separator housing is provided in the cylinder head, and comprises an air intake on one end, and an exhaust outlet on the other end. Furthermore, a reed valve that opens and closes by the change in pressure inside a cam chamber is provided in the air intake. Blowby gas that is guided to the cam chamber hits against the protruding plates when passing in the radial direction of the rotation separator, and oil mist is captured by those protruding plates. Continuing, the blowby gas is guided from the cam chamber into the separator housing via the reed valve. When passing through the reed valve, the flow rate of the blowby gas changes, so oil mist is effectively captured by the inner wall surface of the separator housing.

4 Claims, 8 Drawing Sheets

BREATHER APPARATUS FOR ENGINE

CROSS REFERENCE TO RELATED APPLICATION

This application claims priority under 35 U.S.C. 119 based upon Japanese Patent Application Serial No. 2010-221041, filed on Sep. 30, 2010. The entire disclosure of the aforesaid application is incorporated herein by reference.

FIELD OF THE INVENTION

The present invention relates to an engine breather apparatus that separates oil mist from blowby gas that is led from the crankcase toward the air intake system.

BACKGROUND OF THE INVENTION

Blowby gas flows from the combustion chamber of an engine, through the gap between the piston and cylinder and into the crankcase. This blowby gas becomes a cause of air pollution, so it is necessary that the blowby gas be returned again to the combustion chamber and burned. Therefore, a breather apparatus is used, and by connecting the cylinder head with the air intake system by a breather pipe, this breather apparatus leads the blowby gas from the crankcase to the air intake system.

However, oil mist is included in the blowby gas inside the crankcase, so it is essential that the oil mist be separated from the blowby gas. Therefore, a breather apparatus having simple construction has been developed that separates the oil mist from the blowby gas by installing an oil separator on the cam shaft and turning the oil separator (for example, refer to Japanese Laid-open Patent Publication No. 2009-30580).

By using the breather apparatus disclosed in Japanese Laid-open Patent Publication No. 2009-30580, it was possible to remove a large amount of oil mist from the blowby gas, however, it was difficult to completely remove the oil mist from the blowby gas. The oil mist that is included in the blowby gas is a cause of soiling of the air cleaner element of the air intake system. Therefore, it is desirable that a large amount of the oil mist be removed, while at the same time maintaining the simple construction of the breather apparatus.

SUMMARY OF THE INVENTION

The object of the present invention is to remove a large amount of oil mist from blowby gas while avoiding complicated construction of the breather apparatus.

According to a first embodiment of the present invention for achieving the purpose described above, there is provided a breather apparatus for an engine, the engine being constructed to guide blowby gas from a crankcase to an air intake system of the engine, and being constructed so that the blowby gas passes through at least part of a cam chamber of the engine, and one end of a camshaft of the engine being located in the part of the cam chamber, the breather apparatus comprising:

a rotation separator that is fixed to the one end of the camshaft and that rotates together with the camshaft;

a separator housing that is fixed to a cylinder head so that the separator housing faces the rotation separator, the separator housing having an air intake on the one end thereof that connect to the cam chamber, and having an air outlet on the other end thereof that connects to the air intake system; and a reed valve attached to the air intake to open and close the air intake;

wherein the reed valve allows the blowby gas to flow from the cam chamber to the air intake system through the air intake and the air outlet by opening the air intake when a pressure inside the cam chamber exceeds a specified value;

the rotation separator has a base plate section fixed to the one end of the camshaft, and a plurality of protruding plates extending from an outer circumferential portion of the base plate section toward a direction which is away from the camshaft; and the plurality of protruding plates, by rotating together with the camshaft, remove oil mist from the blowby gas that flows from the cam chamber to the air intake system through the reed value.

According to a second embodiment of the present invention for achieving the purpose above, there is provided The breather apparatus according to the first embodiment 1, wherein the separator housing has:

a gas-liquid separation chamber formed inside the separator housing and between the air intake and the air outlet, one end of this gas-liquid separation chamber being connected to the cam chamber through the air intake;

an exhaust hole that is formed at the other end side of the gas-liquid separation chamber so that the exhaust hole penetrates the separator housing, this exhaust hole having one end and the other end, the one end of the exhaust hole being open in the gas-liquid separation chamber and the other end of the exhaust hole forming the air outlet; and a through hole, formed on the separator housing so as to connect the gas-liquid separation chamber and the cam chamber, for letting oil that is accumulated inside the gas-liquid separation chamber flow into the cam chamber when the pressure inside the cam chamber becomes less than a pressure inside the gas-liquid separation chamber.

According to a third embodiment of the present invention for achieving the purpose described above, there is provided the breather apparatus according to the first embodiment 1, wherein the separator housing has:

a gas-liquid separation chamber formed inside the separator housing and between the air intake and the air outlet, one end of this gas-liquid separation chamber being connected to the cam chamber through the air intake;

a cylindrical portion extending from the other end of the gas-liquid separation chamber toward the rotation separator; and an exhaust hole that is formed inside the cylindrical portion so as to penetrate the separator housing, this exhaust hole has one end and the other end, the one end of the exhaust hole being open in the gas-liquid separation chamber and the other end of the exhaust hole forming the air outlet, wherein the separator housing is formed so that after the blowby gas has entered into the gas-liquid separation chamber from the cam chamber through the reed valve, the blowby gas flows to the air intake system side through the exhaust hole.

With the present invention, after oil mist is separated out by the rotation separator, oil mist is further separated out by the separator housing. As a result, it is possible to remove much oil mist from the blowby gas, so it becomes possible to greatly suppress the amount of oil that is carried out from the crankcase to the air intake system. Moreover, the air intake of the separator housing is opened and closed by a reed valve, so it is possible to change the flow rate of the blowby gas, and thus it becomes possible to effectively separate out oil mist. Furthermore, it is a construction of providing a rotation separator and a separator housing is simple, so it is possible to avoid complicated construction of the breather apparatus.

Other features and advantages of the present invention will become apparent from the following detailed description taken in conjunction with the accompanying drawings, which illustrate, by way of example, the principles of the invention.

DETAILED DESCRIPTION OF THE INVENTION

Figure 1:
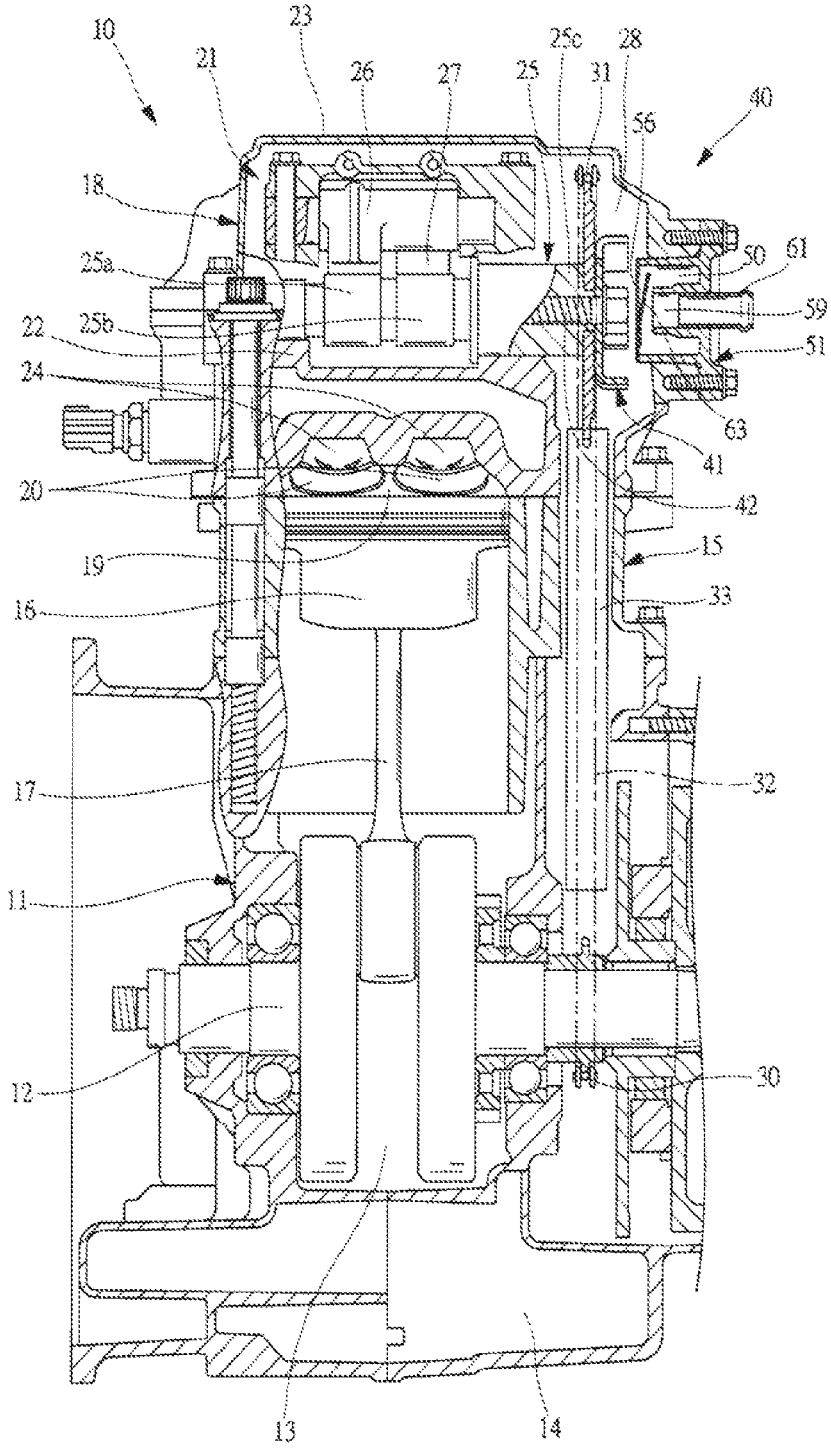
FIG. 1 is a cross-sectional view illustrating the internal construction of an engine.

In the following, an embodiment of the present invention will be explained in detail based on the drawings. FIG. 1 is a cross-sectional view of the internal construction of an engine 10. As illustrated in FIG. 1, the engine 10 has a crankcase 11, and in this crankcase 11 there is a crank chamber 13 that houses the crankshaft 12, and an oil chamber 14 that stores oil (lubrication oil). A cylinder 15 is assembled on the top end of the crankcase 11, and a piston 16 is housed inside the cylinder 15 such that it can freely move back and forth. The crankshaft 12 and the piston 16 are connected via a connecting rod 17. Furthermore, a cylinder head 18 is mounted on the top end of the cylinder 15, and an air intake 20 that opens to a combustion chamber 19 and an exhaust outlet (not illustrated in the figures) are formed in this cylinder head 18. A carburetor and air cleaner box (not illustrated in the figure) of the air intake system 58, which is described below, are connected to the air intake 20. A muffler (not illustrated in the figure) of the exhaust system is connected to the exhaust outlet.

The cylinder head 18 comprises a head main body 22 in which a valve mechanism 21 is installed, and a head cover 23 that is attached to the head main body 22 so that it covers the valve mechanism 21. Also, an air intake valve 24 that opens and closes the air intake port is assembled in the head main body 22, there is also assembled an exhaust valve (not illustrated in the figure) that opens and closes the exhaust outlet. A camshaft 25 that comprises an air intake cam 25*a* and an exhaust cam 25*b* is rotatably supported in the head main body 22. Furthermore, an air intake rocker arm 26 that transmits the rotating motion of the air intake cam 25*a* to the air intake value 24, and an exhaust rocker arm 27 that transmits the rotating motion of the exhaust cam 25*b* to the exhaust value are provided in the head main body 22 such that they rock freely. The camshaft 25 and the like of the valve mechanism 21 are housed in a cam chamber 28 that is located between the head main body 22 and the head cover 23.

Moreover, a timing chain 32 for transmitting the rotation of the crankshaft 12 to the camshaft 25 is passed around a crank sprocket 30 that is fixed to the crankshaft 12 and the cam sprocket 31 that is fixed to the camshaft 25. In order to be able to install this timing chain 32, a connecting path 33 that runs in the vertical direction is formed in the side of the cylinder 15. In other words, the crank chamber 13 of the crankcase 11 and the cam chamber 28 of the cylinder head 18 are connected by the connecting path 33 in the cylinder 15.

In this kind of engine 10, blowby gas leaks from the combustion chamber 19, and passes through between the cylinder 15 and piston 16 into the crankcase 11, so the engine is constructed such that this blowby gas is returned again to the combustion chamber 19 and burned. However, there is oil mist (lubrication oil in a mist form) included in the blowby gas inside the crankcase 11, so it is necessary to separate and remove the oil mist from the blowby gas. Therefore, an engine breather apparatus 40 of an embodiment of the present invention is provided in the engine 10 as illustrated in the figure, and this breather apparatus 40 separates the oil mist from the blowby gas.

Figure 2:
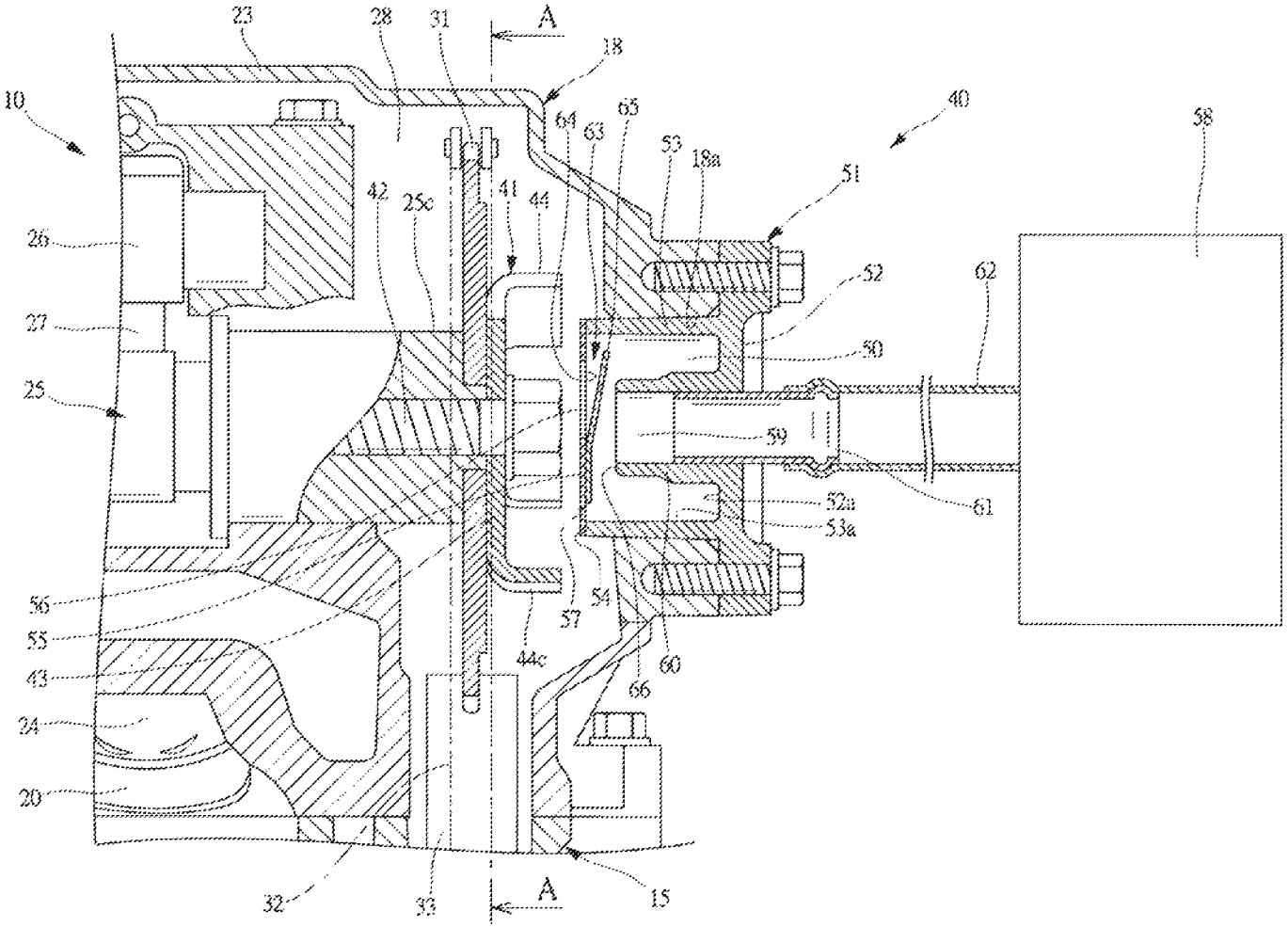
FIG. 2 is a cross-sectional view illustrating a breather apparatus provided in a cylinder head and the construction around it.
Figure 3:
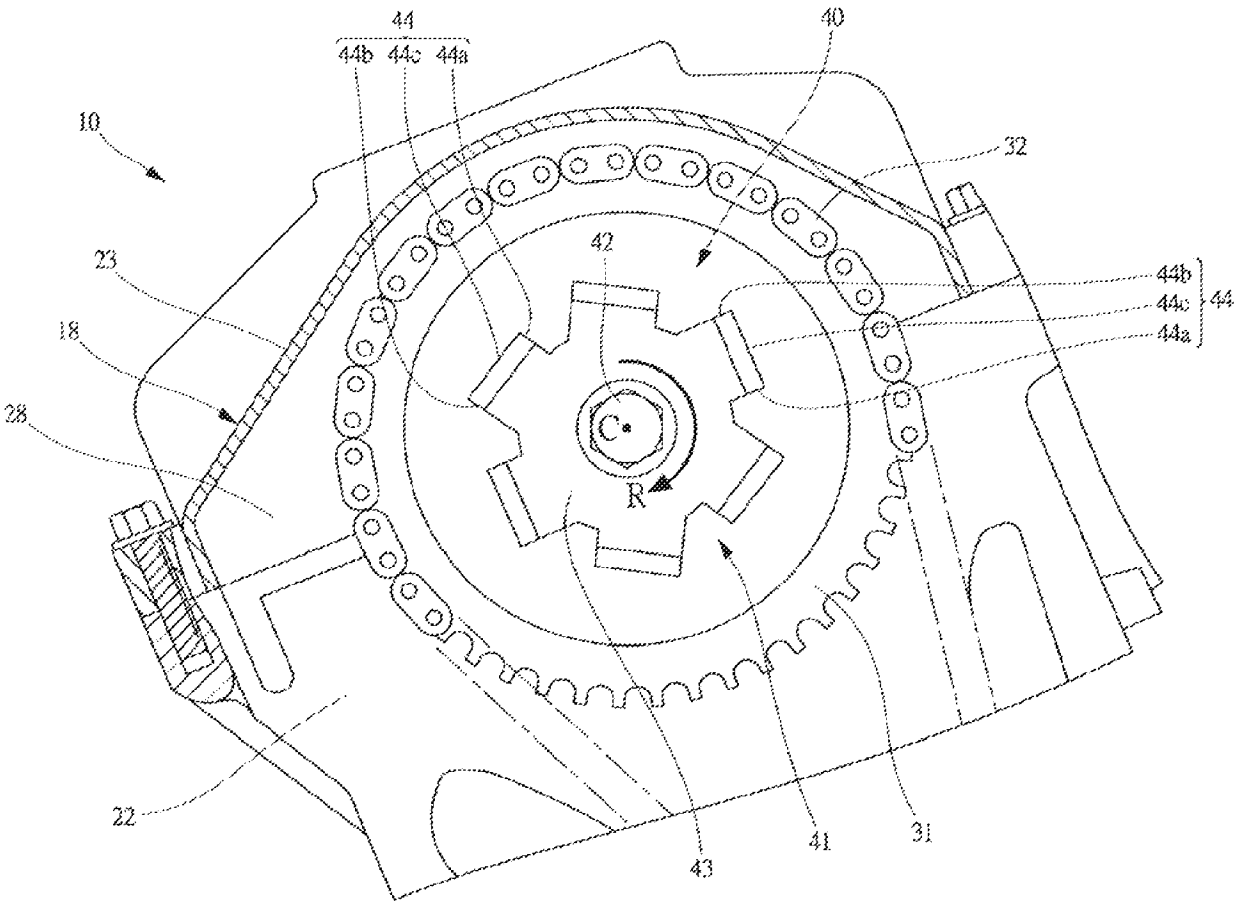
FIG. 3 is a cross-sectional view of section A-A in FIG. 2, and illustrates the breather apparatus and the construction around it.

FIG. 2 is a cross-sectional view illustrating the breather apparatus 40 provided in the cylinder head 18 and the surrounding construction. FIG. 3 is a cross-sectional view illustrating the breather apparatus 40 and surrounding construction along section A-A in FIG. 2. Furthermore, FIG. 4 is an exploded perspective view illustrating the breather apparatus 40 and surrounding construction.

Figure 4:
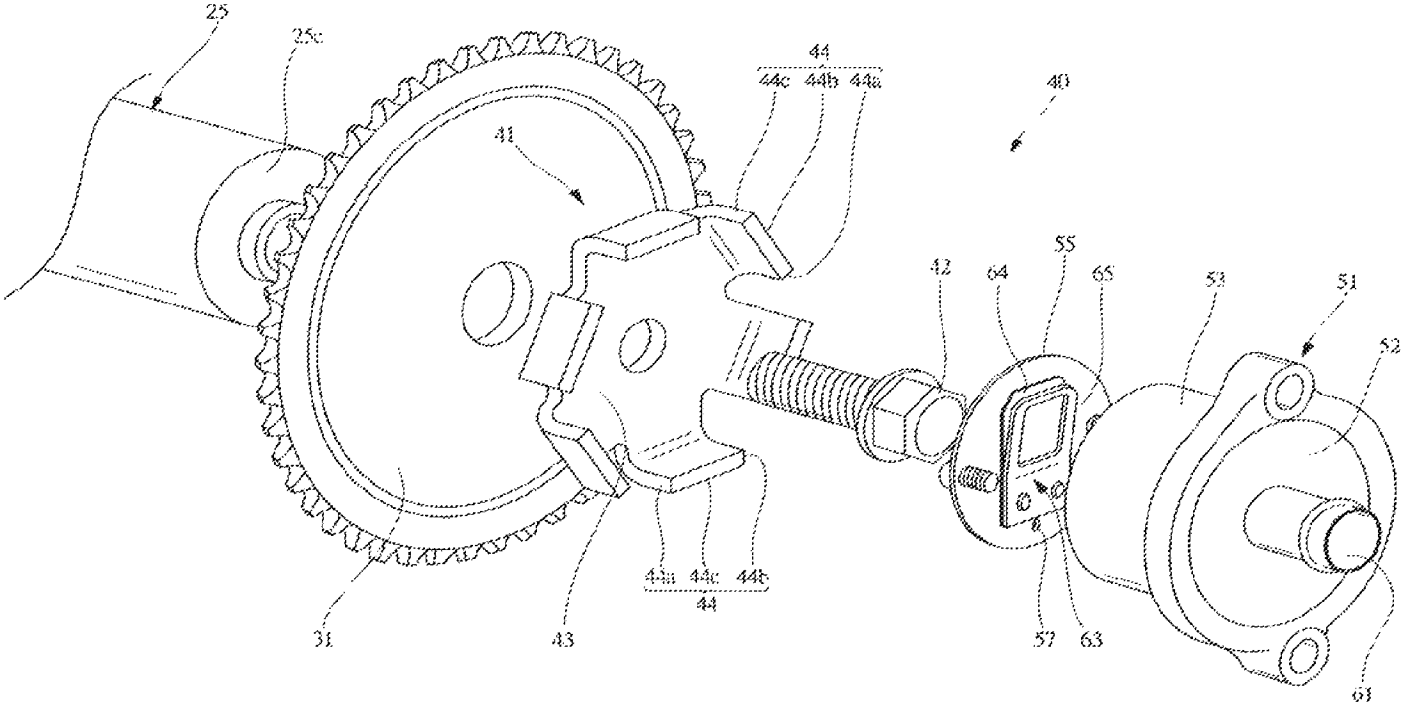
FIG. 4 is an exploded perspective view illustrating the breather apparatus and the construction around it.

As illustrated in FIG. 2 to FIG. 4, a rotation separator 41 is fixed together with the cam sprocket 31 to the end section 25*c* of the camshaft 25 using a bolt member 42. The rotation separator 41 comprises a base plate section 43 that is fixed to the end section 25*c* of the camshaft 25, and a plurality of protruding plates 44 that extend from the base plate section 43 in a direction going away from the camshaft 25. As illustrated in FIG. 3 and FIG. 4, six protruding plates 44 that extend from the base plate section 43 are provided on the rotation separator 41, and the protruding plates 44 are formed by bending part of the base plate section 43 so that they are substantially perpendicular to the base plate section 43. In other words, each protruding plate 44 is formed such that it extends parallel with the axial direction of the camshaft 25. As illustrated in FIG. 3, the rotation separator 41 rotates in the direction of the arrow R. Furthermore, the front end section 44*a* of the protruding plate 44 that is located on the front side in the direction of the rotation is formed so that, compared with the rear end section 44*b* of the protruding plate 44 that is located on the rear side in the direction of the rotation, it is away from the center of rotation C of the rotation separator 41. In other words, the outer surface 44*c* of each protruding plate 44 is formed so that it is sloped with respect to the direction of the rotation. The rotation separator 41 that is illustrated in the figure can be formed by adapting press forming to a steel plate that has been punched into a specified shape.

Moreover, as illustrated in FIG. 2, a cylindrical shaped separator housing 51, the inside of which is divided off into a gas-liquid separation chamber 50, is attached to the opening 18*a* on the side wall of the cylinder head that faces the rotation separator 41. This separator housing 50 has a circular plate section 52 that is fastened to the side wall of the cylinder head 18, and a cylindrical section 53 that extends from the circular plate section 52 to inside the cam chamber 28. A partition plate 55 is fastened to the opening end of the cylindrical section 53, and an air intake 56 and a through hole 57 are formed in the partition plate 55 on one end of the separator housing 51. Furthermore, an exhaust outlet 59 that connects to the air induction system 58 is formed in the circular plate section of the other end of the separator housing 51. A cylindrical wall 60 that surrounds the exhaust outlet 59 and extends toward the partition plate 55 is formed in the circular plate section 52. The air induction system 58 is connected to the exhaust outlet 59 of the circular plate section 52 by way of an exhaust pipe 61 and exhaust hose 62.

Figure 5:
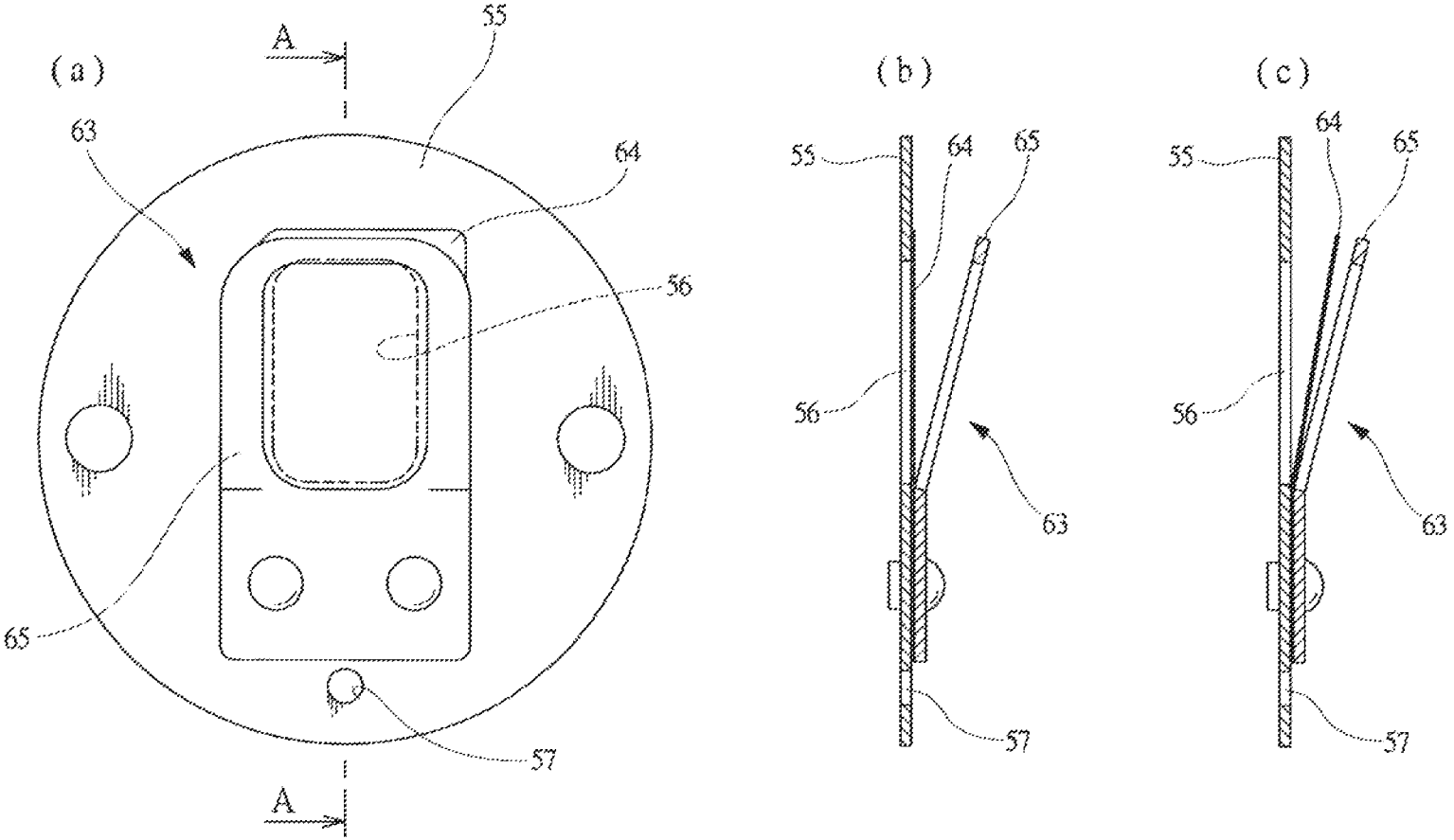
FIG. 5A is an enlarged top view illustrating a partition plate and reed valve.
FIG. 5B and FIG. 5C are enlarged cross-sectional views of section A-A, and illustrate the partition plate and reed valve.

As illustrated in FIG. 2 and FIG. 4, a reed valve 63, which is also called a leaf valve, is attached to the partition plate 55 of the separator housing 51. This reed valve 63 is attached so as to cover the air intake 56 in the partition plate 55. The reed valve 63 allows flow from the cam chamber 28 toward the gas-liquid separation chamber 50, and blocks flow from the gas-liquid separation chamber 50 toward the cam chamber 28. Here, FIG. 5A is an enlarged top view illustrating the partition plate 55 and reed valve 63, and FIG. 5B and FIG. 5C are enlarged cross-sectional views that illustrate the partition plate 55 and reed valve 63 along the line B-B in FIG. 5(*a*). As illustrated in FIG. 5A and FIG. 5B, the read valve 63 has a reed piece 64 that is able to deform elastically, and a stopper 65 that restricts the amount of slope of the reed piece 64. When the pressure inside the cam chamber 28 drops as the piston 16 rises toward the top dead center, the reed piece 64 of the read valve 63 having this kind of construction closes and covers the air intake 56 as illustrated in FIG. 5B. On the other hand, when the pressure inside the cam chamber 28 rises as the piston 16 lowers toward the bottom dead center, the elastically deforming reed piece 64 opens the air intake 56.

Figure 6:
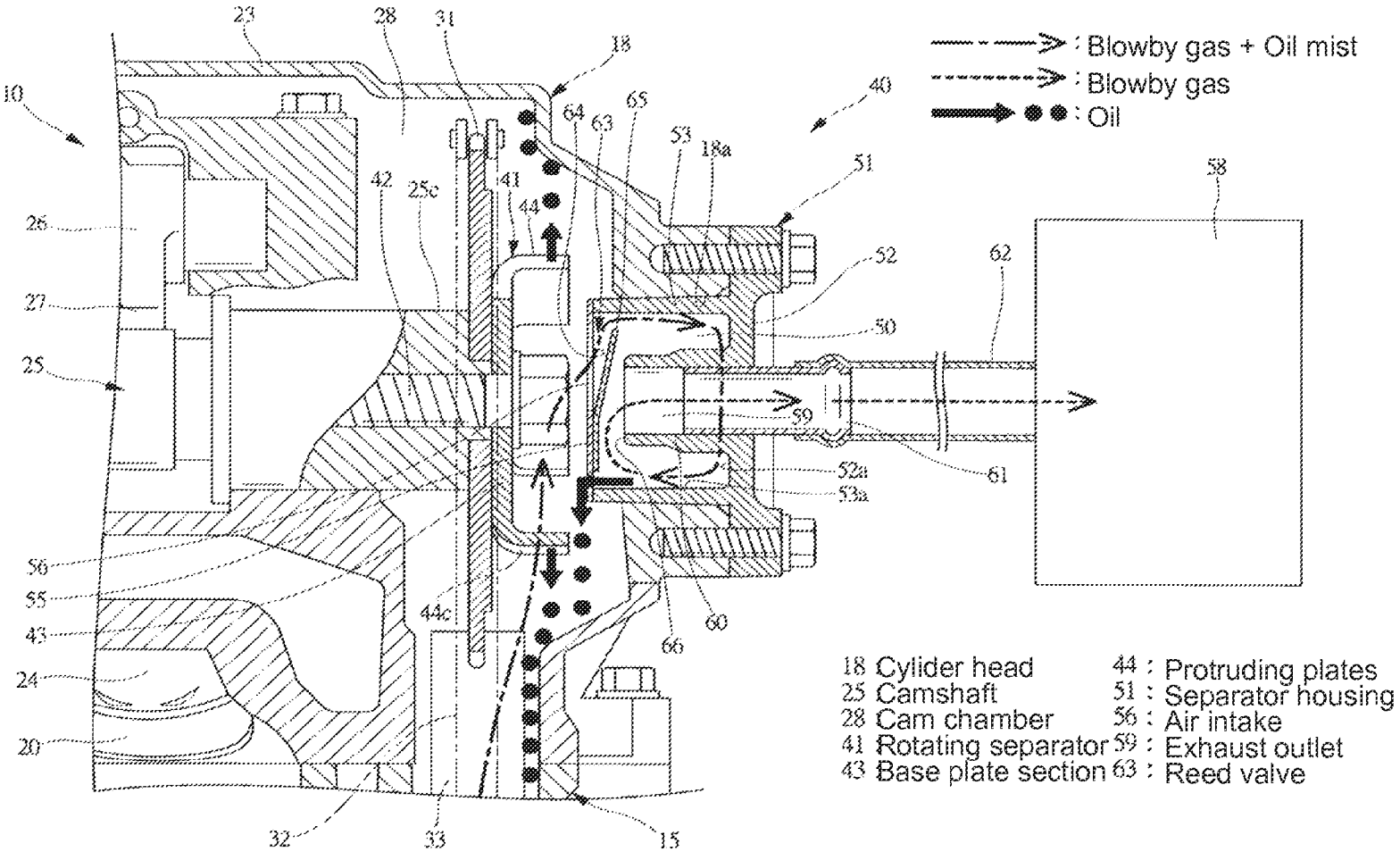
FIG. 6 is an explanation diagram illustrating the separation state of oil mist by the breather apparatus.
Figure 7:
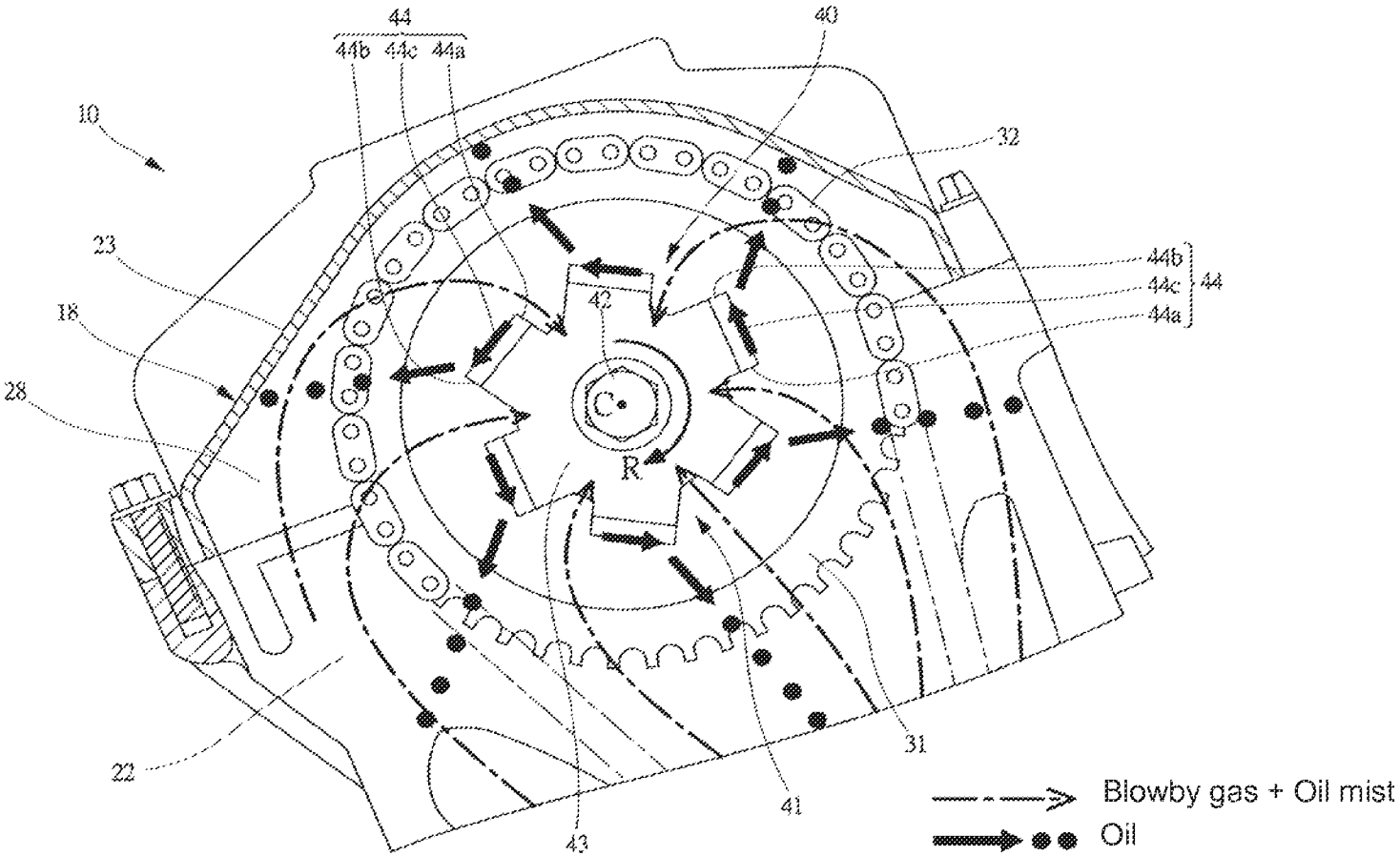
FIG. 7 is an explanation diagram illustrating the separation state of oil mist by the breather apparatus.

Next, the oil mist separation function of the breather apparatus 40 of the present invention is explained. FIG. 6 and FIG. 7 are explanatory drawings illustrating the oil mist separation status of the breather apparatus 40, where FIG. 6 illustrates the same part as in FIG. 2, and FIG. 7 illustrates the same part as in FIG. 3. As illustrated in FIG. 6 and FIG. 7, blowby gas that includes oil mist is guided through the connecting path 33 from the crank chamber 13 of the crankcase 11 to the cam chamber 28 of the cylinder head 18. The blowby gas that is guided to the cam chamber 28 in this way passes in the radial direction through the rotation separator 41 toward the center of rotation C. At this time, the blowby gas hits against the protruding plates 44 of the rotation separator 41, so oil mist adheres to the outer surfaces 44*c* of the protruding plates 44 and is separated from the blowby gas. The oil (oil drops) that adheres to the protruding plates 44 run toward the rear end sections 44*b* of the protruding plates 44, after which the oil is scattered toward the outside in the radial direction of the rear end sections 44*b* by centrifugal force. In this way, when the blowby gas passes in the radial direction through the rotation separator 41, the oil mist is removed from the blowby gas by the protruding plates 44. The oil that is scattered from the rotating separator adheres to the inner wall of the cylinder head 18, and then runs down toward the crankcase 11. As was described above, the protruding plates 44 of the rotation separator 41 are sloped with respect to the direction of rotation, so it is possible to effectively scatter the oil that is adhered to the protruding plates 44.

In this way, much oil mist is removed by way of the rotation separator 41 from the blowby gas. As illustrated in FIG. 6, the blowby gas is guided through the reed valve 63 that is opened or closed by the up and down movement of the piston 16 to inside the separator housing 51. The blowby gas that is guided to the gas-liquid separation chamber 50 inside the separator housing 51 flows between the cylindrical section 53 and the cylindrical wall 60 and is returned to circular plate section 52, then is guided from the opening end 66 of the cylindrical wall 60 to the exhaust outlet 59. In this separator housing 51, when the blowby gas is flowing into the gas-liquid separation chamber 50, the blowby gas that passes through the reed valve 63 accelerates and enters into the gas-liquid separation chamber 50. Therefore, the blowby gas hits against the inner wall surface of the cylindrical section 53, and oil mist adheres to the inner wall surface 53*a*. Furthermore, the blowby gas is turned back by the circular plate section 52, so the blowby gas hits against the inner wall surface 52*a* of the circular plate section 52 and oil mist adheres to the inner wall surface 52*a*.

In this way, blowby gas is led from the cam chamber 28 to the gas-liquid separation chamber 50 inside the separator housing 51 by way of the reed valve 63. This reed valve 63 is opened and closed by being linked to the up and down motion of the piston 16, so it is possible to change (accelerate or decelerate) the flow rate of the blowby gas. In other words, the air intake 56 is not continuously opened by the reed value 63 and it is possible to change the flow rate of the blowby gas by closing the air intake 56, so it is possible to separate out much oil mist from the blowby gas. Furthermore, the gas-liquid separation chamber 50 inside the separator housing 51 has complex construction that comprises a cylindrical wall 60. Therefore, it possible to move the blowby gas to each of the inner wall surfaces 52*a*, 53*a* of the gas-liquid separation chamber 50 as the blowby gas hits against the inner wall surfaces 52*a*, 53*a*, and as a result, it is possible to cause much oil mist to adhere to the inner wall surfaces 52*a*, 53*a* and to remove that oil mist.

The oil that adhered to the inner wall surfaces 52*a*, 53*a* of the separator housing 51 builds up on the bottom section of the separator housing 51 due to gravity. Here, a through hole 57 is formed in the partition plate 55 of the separator housing 51 below the air intake 56. A through hole 57 that connects to the cam chamber 28 is formed in the bottom section of the separator housing 51 in this way, so the oil that has built up is periodically sucked out through the through hole 57 to the cam chamber 28 side. In other words, when the pressure inside the cam chamber 28 drops as the piston 16 rises, the pressure in the cam chamber 28 drops more than in the gas-liquid separation chamber 50. As a result, oil is sucked out from the through hole 57 to the cam chamber 28 side. The oil that is caught by the separator housing 51 in this way is returned through the through hole 57 to the inside of the cam chamber 28, so there is no need for a return pipe for returning the oil, and thus it is possible to lower the cost of the breather apparatus 40. As illustrated in FIG. 6, the partition plate 55 of the separator housing 51 and the tip end surfaces of the protruding plates 44 of the rotation separator 41 face each other through a specified space. As a result, when sucking out the oil from the through hole 57 to the cam chamber 28 side, it is possible to cause the oil to drop down without hitting against the protruding plates 44.

Figure 8:
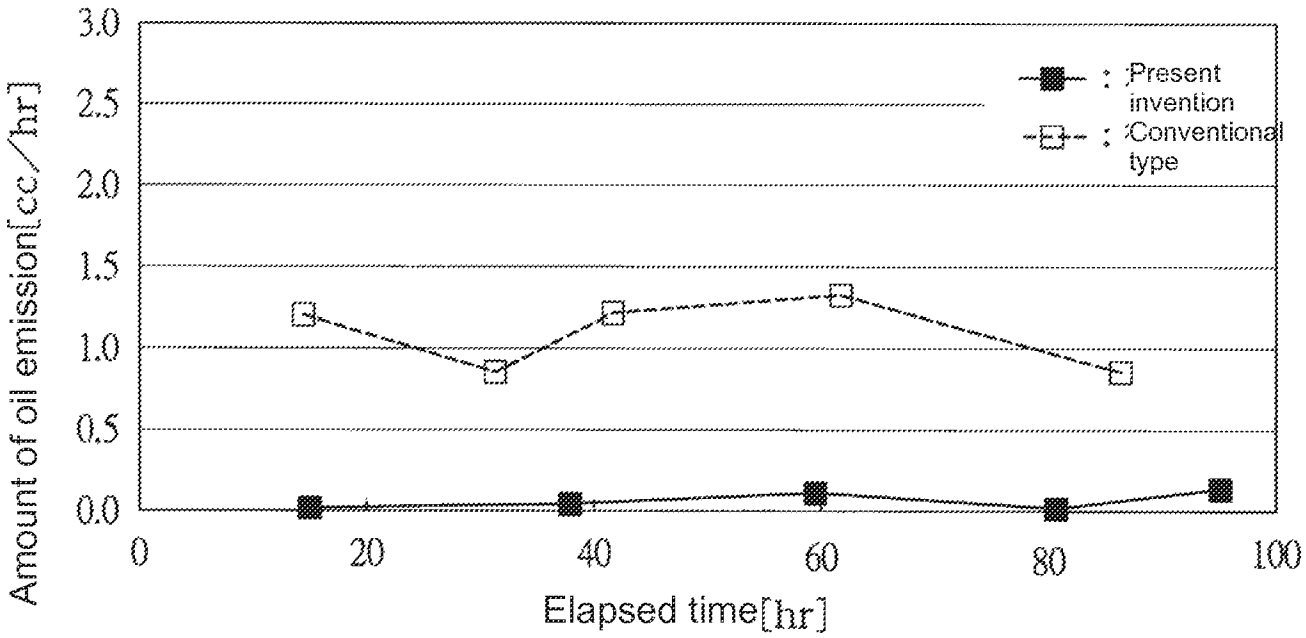
FIG. 8 is a comparison diagram illustrating test data for the amount of oil discharged per unit time.

As explained above, after the oil mist has been separated out from the blowby gas by the rotation separator 41, oil mist is further separated out from the blowby gas by the separator housing 51 that comprises a reed valve 63. As a result, it is possible to remove much oil mist from the blowby gas, so it becomes possible to greatly suppress the amount of oil that is carried into the air induction system 58 (oil emission amount) from the crankcase 11. Here, FIG. 8 is a comparison diagram illustrating test data for the amount of oil emission per unit time. FIG. 8 illustrates the amount of oil emission when using the breather apparatus 40 of the present invention, and the amount of oil emission when using a conventional breather apparatus. As the conventional breather apparatus, testing was performed using a breather apparatus comprising a row of inside annular fins and a row of outside annular fins as disclosed in FIG. 8 of Japanese Laid-open Patent Publication No. 2009-30580 as an example of related art. As illustrated in FIG. 8, when compared with the conventional breather apparatus, the breather apparatus 40 of the present invention is able to reduce the amount of oil emission by 90% or more.

By using a rotation separator 41 and a separator housing 51 comprising a reed valve 63 in this way, it becomes possible to remove much oil mist from the blowby gas. As a result, not only is it possible to suppress the amount of oil emission, but it is also possible to prevent the air induction system 58 from become dirty due to oil mist being carried in, so it becomes possible to achieve simplification of the maintenance work for maintaining the engine 10. Moreover, construction is simple in that together with providing a rotation separator 41, a separator housing 51 comprising a reed valve 63 is provided, so it becomes possible to achieve a compact and low cost breather apparatus 40.

The present invention is not limited to the embodiments above, and needless to say various modifications are possible within a range that does not depart from the scope of the invention. For example, in the explanation above, six protruding plates 44 were formed in the rotation separator 41, however the number is not limited to this, and it is also possible to form five or fewer protruding plates 44, or form seven or more protruding plates 44. Moreover, preferably the protruding plates 44 of the rotation separator 41 are sloped with respect to the direction of rotation, however, the protruding plates 44 can be formed without being sloped with respect to the direction of rotation. Furthermore, in the explanation above, the exhaust outlet 59 of the separator housing 51 is arranged such that it is concentric with the center of rotation C of the rotation separator 41, however the location is not limited to this, and the exhaust outlet 59 could be offset from the center for rotation C.

Moreover, in the explanation above, a through hole 57 is formed in the partition plate 55, however, the invention is not limited to this, and it is possible to form a through hole in the cylindrical section 53 of the separator housing 51 that connects to the cam chamber 28. Furthermore, it is possible to form a notch on the opening end 66 of the cylindrical section 53, and to have this notch function as a through hole that connects with the cam chamber 28.

It is to be understood that the above-described embodiments are illustrative of only a few of the many possible specific embodiments that can represent applications of the principles of the invention. Numerous and varied other arrangements can be readily devised by those skilled in the art without departing from the spirit and scope of the invention.

The invention claimed is:

1. A breather apparatus for an engine, the engine being constructed to guide blowby gas from a crankcase to an air intake system of the engine, and being constructed so that the blowby gas passes through at least part of a cam chamber of the engine, and one end of a camshaft of the engine being located in the part of the cam chamber, the breather apparatus comprising:

a rotation separator that is fixed to the one end of the camshaft and that rotates together with the camshaft;

a separator housing that is fixed to a cylinder head so that the separator housing faces the rotation separator, the separator housing having an air intake on the one end thereof that connect to the cam chamber, and having an air outlet on the other end thereof that connects to the air intake system; and a reed valve attached to the air intake to open and close the air intake;

wherein the reed valve allows the blowby gas to flow from the cam chamber to the air intake system through the air intake and the air outlet by opening the air intake when a pressure inside the cam chamber exceeds a specified value;

the rotation separator has a base plate section fixed to the one end of the camshaft, and a plurality of protruding plates extending from an outer circumferential portion of the base plate section toward a direction which is away from the camshaft; and the plurality of protruding plates, by rotating together with the camshaft, remove oil mist from the blowby gas that flows from the cam chamber to the air intake system through the reed value.

2. The breather apparatus according to claim 1, wherein the separator housing has:

a gas-liquid separation chamber formed inside the separator housing and between the air intake and the air outlet, one end of this gas-liquid separation chamber being connected to the cam chamber through the air intake;

an exhaust hole that is formed at the other end side of the gas-liquid separation chamber so that the exhaust hole penetrates the separator housing, this exhaust hole having one end and the other end, the one end of the exhaust hole being open in the gas-liquid separation chamber and the other end of the exhaust hole forming the air outlet; and a through hole, formed on the separator housing so as to connect the gas-liquid separation chamber and the cam chamber, for letting oil that is accumulated inside the gas-liquid separation chamber flow into the cam chamber when the pressure inside the cam chamber becomes less than a pressure inside the gas-liquid separation chamber.

3. The breather apparatus according to claim 1, wherein the separator housing has:

a gas-liquid separation chamber formed inside the separator housing and between the air intake and the air outlet, one end of this gas-liquid separation chamber being connected to the cam chamber through the air intake;

a cylindrical portion extending from the other end of the gas-liquid separation chamber toward the rotation separator; and an exhaust hole that is formed inside the cylindrical portion so as to penetrate the separator housing, this exhaust hole has one end and the other end, the one end of the exhaust hole being open in the gas-liquid separation chamber and the other end of the exhaust hole forming the air outlet, wherein the separator housing is formed so that after the blowby gas has entered into the gas-liquid separation chamber from the cam chamber through the reed valve, the blowby gas flows to the air intake system side through the exhaust hole.

4. An engine being constructed to guide blowby gas from a crankcase to an air intake system of the engine, and being constructed so that the blowby gas passes through at least part of a cam chamber of the engine, and one end of a camshaft of the engine being located in the part of the cam chamber, the engine comprising:

a rotation separator that is fixed to the one end of the camshaft and that rotates together with the camshaft;

a separator housing that is fixed to a cylinder head so that the separator housing faces the rotation separator, the separator housing having an air intake on the one end thereof that connect to the cam chamber, and having an air outlet on the other end thereof that connects to the air intake system; and a reed valve attached to the air intake to open and close the air intake;

wherein the reed valve allows the blowby gas to flow from the cam chamber to the air intake system through the air intake and the air outlet by opening the air intake when a pressure inside the cam chamber exceeds a specified value;

the rotation separator has a base plate section fixed to the one end of the camshaft, and a plurality of protruding plates extending from an outer circumferential portion of the base plate section toward a direction which is away from the camshaft; and the plurality of protruding plates, by rotating together with the camshaft, remove oil mist from the blowby gas that flows from the cam chamber to the air intake system through the reed value.

* * * * *